United States Patent [19]

Althaus et al.

[11] Patent Number: 5,069,600

[45] Date of Patent: Dec. 3, 1991

[54] PRESSURE WAVE MACHINE

[75] Inventors: Rolf Althaus, St. Gallen; Erwin Zauner, Baden, both of Switzerland

[73] Assignee: Asea Brown Boveri Ltd., Baden, Switzerland

[21] Appl. No.: 619,425

[22] Filed: Nov. 29, 1990

[30] Foreign Application Priority Data

Dec. 6, 1989 [CH] Switzerland ..... 4374/89

[51] Int. Cl.[5] ..... F04F 11/00

[52] U.S. Cl. ..... 417/64; 60/39.45

[58] Field of Search ..... 60/39.45 A, 39.45 R; 417/64; 123/559.1

[56] References Cited

U.S. PATENT DOCUMENTS 2,766,928 10/1956 Jendrassik ..... 417/64
3,055,577 9/1962 Vickery ..... 417/64
4,529,360 7/1985 Kirchhofer et al. ..... 417/64

FOREIGN PATENT DOCUMENTS 279081 10/1914 Fed. Rep. of Germany .
3014518 10/1980 Fed. Rep. of Germany .
378595 7/1964 Switzerland .
680358 10/1952 United Kingdom .
967525 8/1964 United Kingdom .

*Primary Examiner*—Richard A. Bertsch
*Assistant Examiner*—Charles Freay
*Attorney, Agent, or Firm*—Burns, Doane, Swecker & Mathis

[57] ABSTRACT

This pressure wave machine has a cell wheel (2) with a longitudinal axis (3) which is supported in a casing by means of a bearing. One end face (4) of the cell wheel (2) interacts with a hot gas guidance casing (6) and the other (5) interacts with a gas guidance casing (8) by means of a radially directed sealing gap (7, 9) in each case. The invention is intended to provide a pressure wave machine (1) whose performance during a cold start is the same as that after the operating temperature has been reached. This is achieved in that the radially directed sealing gaps (7, 9) have at least one gap extensions (20, 21) inclined to the longitudinal axis and that flanks (22, 23, 28, 29) of this gap extension are located on the generated surfaces of cones which have a common apex on the longitudinal axis (3).

22 Claims, 2 Drawing Sheets

PRESSURE WAVE MACHINE

BACKGROUND OF THE INVENTION

1. Field of the Invention

The present invention is based on a pressure wave machine with a cell wheel which has a longitudinal axis and is supported by means of a bearing in a casing, one end face of which cell wheel interacting with a hot gas guidance casing by means of a first radially directed sealing gap and its other end face interacting with a gas guidance casing by means of a second radially directed sealing gap.

2. Discussion of Background

A pressure wave machine is known from the patent specification CH 378 595, this pressure wave machine exhibiting radially extending sealing gaps both between a hot gas guidance casing and a cell wheel and between a gas guidance casing and the cell wheel. This sealing gap must have sufficiently large dimensions to prevent the thermally expanding cell wheel, or its end faces, from rubbing on the hot gas or the gas guidance casings even after reaching the particular maximum operating temperature. In the cold condition, i.e. when the pressure wave machine is being run up, these sealing gaps are initially relatively wide so that a working medium, such as compressed hot gas or compressed air, escapes through these gaps - thus causing an undesirable reduction in performance at the beginning of the running-up phase. It is only in the warm condition, when the sealing gaps have become smaller, that working medium escapes to an unavoidable and consequently tolerable extent.

SUMMARY OF THE INVENTION

Accordingly, one object of this invention is to provide a pressure wave machine whose performance during a cold start is the same as that after the operating temperature has been reached.

The advantages achieved by means of the invention may be essentially seen in the fact that sealing gaps between the cell wheel and adjacent casings are designed in such a way that they remain constant or approximately constant over wide temperature ranges independent of temperature fluctuations. The efficiency of the pressure wave machine is increased because the leakage losses through these sealing gaps are substantially smaller during the starting phase than is the case with conventional pressure wave machines.

The further embodiments of the invention are the object matter of the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
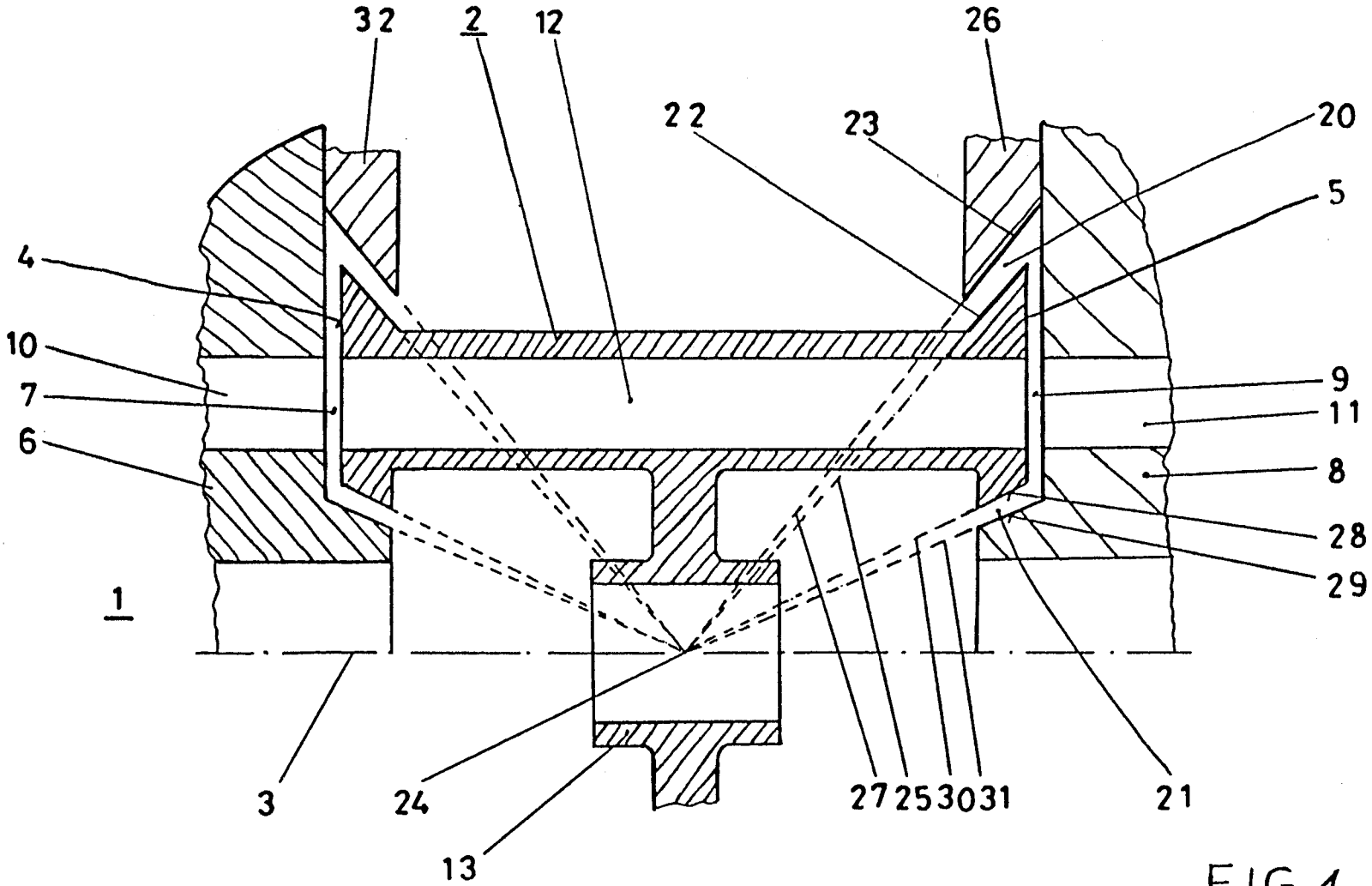
FIG. 1 shows a much simplified sketch of an embodiment of a pressure wave machine.

Referring now to the drawings, wherein like reference numerals designate identical or corresponding parts throughout the views, FIG. 1 shows a diagrammatic sketch of a pressure wave machine 1 in half-section. A cell wheel 2 is rotatably located about a longitudinal axis 3. The cell wheel 2 has end faces 4 and 5 which extend radially relative to the longitudinal axis 3. The end face 4, together with a hot gas guidance casing 6 located opposite to it, forms the boundaries in the axial direction of a radially directed sealing gap 7. The end face 5, together with a gas guidance casing 8 located opposite to it, forms the boundaries in the axial direction of a radially directed sealing gap 9. The hot gas guidance casing 6 and the gas guidance casing 8 are shown rotated relative to one another in order to make FIG. 1 more easily understood; they both have ducts 10, 11 for the guidance of gases flowing through the pressure wave machine 1. The cell wheel 2 shown has cells 12 in a single-flow arrangement but multi-flow designs are also possible; it also has a hub 13 on the inside. Space is provided in the hub 13 for a bearing, not shown, which is rigidly connected to the hub 13 at one end and is supported on the gas guidance casing 8 at the other. The bearing is designed in such a way that bearing play in the axial direction is avoided. The cell wheel 2 is screened from the outside by means of an outer casing, not shown, which also connects the hot gas guidance casing 6 to the gas guidance casing 8.

The sealing gap 9 has a first gap extension 20 and a second gap extension 21, these being inclined relative to the longitudinal axis 3 in the direction towards the inside of the cell wheel 1. The gap extension 20 has boundaries formed by two flanks 22 and 23. The flank 22 is formed by the machined surface of a thickening provided on the outside of the rotating cell wheel 2. This flank 22 may be regarded as an annular segment of the generated surface of a first cone. The continuation of this first cone to its apex located at a point 24 on the longitudinal axis 3 is indicated by a dotted line 25. The flank 23 is the inner termination of a rotationally symmetrical flange 26 connected to the gas guidance casing 8. The flank 23 may be regarded as an annular segment of the generated surface of a second cone. The continuation of this second cone to its apex, also located at the point 24, is indicated by a dotted line 27. The boundaries of the gap extension 21 are formed by two flanks 28 and 29, it being possible to regard the flank 28 as part of the surface of the cell wheel 2 and the flank 29 as being rotationally symmetrically machined into the gas casing housing 8. These two flanks 28 and 29 can be each regarded as an annular segment of the generated surface of a respective cone. The cone associated with the flank 28 is indicated by a dotted line 30 which leads to its apex, again located at the point 24. The cone to be associated with the flank 29 is indicated by a dotted line 31 which leads to its apex, similarly located at the point 24.

The sealing gap 7 on the left-hand side of the pressure wave machine also has gap extensions constructed in a manner corresponding to the gap extensions 20 and 21. The termination of the outer gap extension in the radial direction is formed by a flange 32 which is designed similarly to the flange 26 and which is connected to the hot gas guidance casing 6. The sealing gaps 7 and 9 and their extensions are not shown to scale in this figure in order to make the drawing more easily understood. For the same reason, visible edges are not shown.

The pressure wave machine 1 is here shown symmetrically constructed with the point 24 in the center of the cell wheel 2. Generally speaking, however, such a favorable symmetrical construction cannot be achieved so that the hub 13 has to be displaced to the left or the right in the axial direction. This displacement means that the point 24 has to be displaced along the means that the point 24 has to be displaced along the longitudinal axis 3 in each case. The point 24 is always arranged in such a way that it is located in the center of the bearing of the cell wheel 2. It is also conceivable that a sealing gap provided on the left-hand side of the cell wheel 2 should be designed differently from the right-hand side for operational reasons. It is also possible to provide only the outer gap extension 20 in each case, the inner gap 21, on the other hand, not being implemented.

Figure 2:
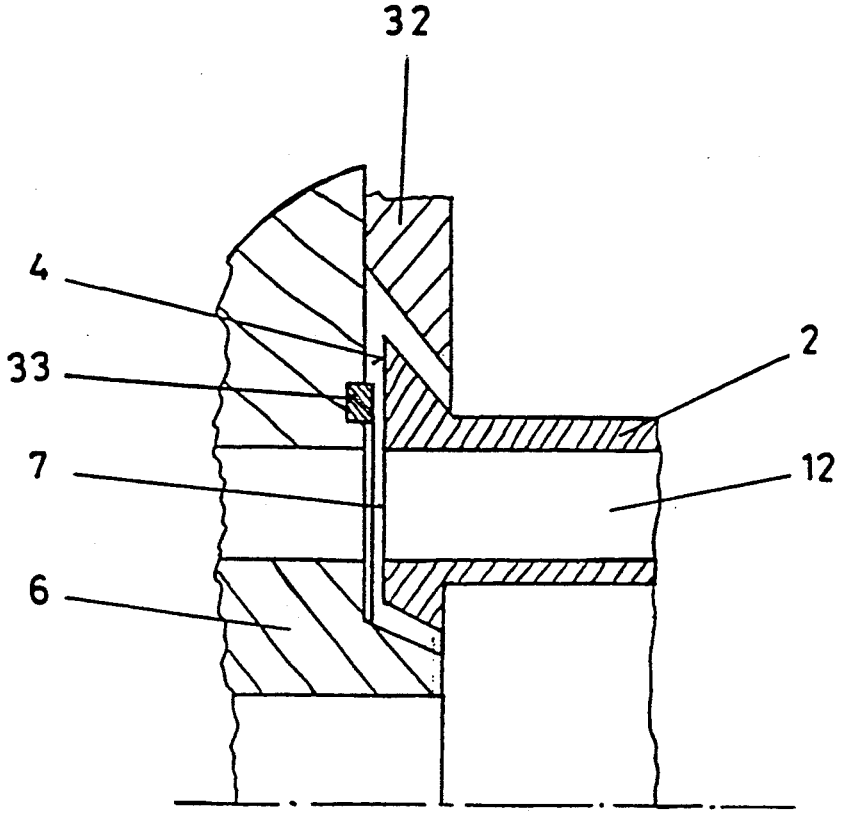
FIG. 2 shows a partial section through a pressure wave machine.

FIG. 2 shows a partial section through a pressure wave machine. A rubbing ring 33 is let into the hot gas guidance casing 6 in this case. The rubbing ring 33 prevents the end face 4 of the cell wheel 2 coming into direct contact with the hot gas guidance casing 6 if the cell wheel 2 should expand to such an extent that the sealing gap 7 is bridged over. Instead of the rubbing ring 33 extending over the complete periphery, it is also possible to provide individual sliding bodies distributed evenly around the periphery. These sliding bodies or the sliding ring 33 can be composed of a metal alloy, of a material containing graphite or of ceramic, in particular zirconium oxide. It is, however, also possible to coat the end face 4 or the opposite region of the hot gas guidance casing 6 so that they can slide. Corresponding measures against contact can also be taken in the sealing gap 9.

The mode of operation of this pressure wave machine 1 is briefly explained using FIG. 1, it being unnecessary to describe the actual supercharging of gases with the aid of pressure wave processes taking place in the cells 12 of the cell wheel 2. As the amount of working medium under pressure lost while the gases are flowing into or out of the cells 12 becomes smaller, the efficiency of the pressure wave machine becomes higher. A pressure drop necessarily occurs due to the radially directed sealing gaps. In the cold condition of the pressure wave machine, these sealing gaps are relatively large and they become smaller as the pressure wave machine heats up until they reach an optimum size after reaching the operating temperature. In the pressure wave machine 1 according to the invention, the actual sealing function is no longer undertaken solely by the radially extending sealing gaps 7 and 9; on the contrary, the gap extensions 20 and 21 represent the actual sealing locations.

The cell wheel 2 expands during heating and, presented in a simplified manner, this takes place in the direction of rays spreading from the central point 24, which may be considered as a fixed point. The dotted lines 25 and 30 indicate such rays in the plane of the drawing and the extensions of these rays are formed by the flanks 22 and 28 which are therefore displaced in the direction of their particular associated dotted lines 25 and 30. The surroundings of the cell wheel 2 heat up at the same time so that the gas guidance casing 8, together with the flange 26, also expands. The flank 23 machined into the flange 26 and the flank 29 machined into the gas guidance casing 8 also expand in the direction of their particular associated dotted lines 23 and 31. This expansion behavior can be adjusted by a selection of the material for the gas guidance casing 8, the flange 26, the outer casing and the hot gas guidance casing 6, with flange 32, to suit the material of the cell wheel 2 or its coefficient of expansion.

The distance between the flanks 22 and 23 of the gap extension 20 and that between the flanks 28 and 29 of the gap extension 21 therefore remains constant independent of temperature. These distances can therefore be selected to be relatively small because there is no danger of rubbing. By this means, good sealing, and hence uniform performance of the pressure wave machine 1, is achieved over the whole of the temperature range up to the operating temperature. The transition, designed as a kink in each case, between the radially directed sealing gaps and the gap extensions additionally improves the sealing because gas under pressure can only flow away with difficulty through this kink, which acts like a labyrinth. The thickness of the radially directed sealing gaps 7 and 9 is of secondary importance in this design of the pressure wave machine 1 so that relatively high manufacturing tolerances are possible in this case, this making manufacture less expensive.

The rubbing rings 33 prevent damage due to any possible rubbing of the cell wheel 2 on the hot gas guidance casing 6 or on the gas guidance casing 8. The rubbing rings 33 can be installed on both sides of the cell wheel 2. They consist of a material which is resistant to wear.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Pressure wave machine (1) with a cell wheel (2) which has a longitudinal axis (3) and is supported by means of a bearing in a casing, one end face (4) of which cell wheel interacting with a hot gas guidance casing (6) by means of a first radially directed sealing gap (7) and its other end face (5) interacting with a gas guidance casing (8) by means of a second radially directed sealing gap (9), wherein at least one of the radially directed sealing gaps (7, 9) has at least one gap extension (20) inclined relative to the longitudinal axis (3) and having two flanks (22, 23)

both the flank (22) on the cell wheel end and the flank (23) opposite to it on the casing end of the at least one gap extension (20) are respectively located on the generated surface of a cone, and each of these two cones has an apex on the longitudinal axis (3) inside the cell wheel (2).

2. Pressure wave machine as claimed in claim 1, wherein, both the flank (22) on the cell wheel end and the flank (23) on the casing end are designed as an annular segment of the generated surface of the particular cone.

3. Pressure wave machine as claimed in claim 1, wherein both the apex of the first cone and the apex of the second cone are located at the same point (24) of the longitudinal axis (3).

4. Pressure wave machine as claimed in claim 1, wherein both the apex of the first cone and the apex of the second cone are located at the same point (24) of the longitudinal axis (3), and this point (24) is located in the center of the bearing of the cell wheel (2).

5. Pressure wave machine as claimed in claim 1, wherein sliding bodies are fastened on the hot gas guidance casing (6) and on the gas guidance casing (8) opposite to the particular end face (4, 5) of the cell wheel (2).

6. Pressure wave machine as claimed in claim 5, wherein these sliding bodies are composed of a metal alloy.

7. Pressure wave machine as claimed in claim 6, wherein the sliding bodies are designed as an annular rubbing ring (33).

8. Pressure wave machine as claimed in claim 1, wherein sliding bodies are fastened on the hot gas guidance casing (6) or on the gas guidance casing (8) opposite to the particular end face (4,5) of the cell wheel (2).

9. Pressure wave machine as claimed in claim 5, wherein these sliding bodies are composed of a material containing graphite.

10. Pressure wave machine as claimed in claim 5, wherein these sliding bodies are composed of a ceramic material.

11. Pressure wave machine as claimed in claim 10, wherein the ceramic material is zirconium oxide.

12. Pressure wave machine as claimed in claim 9, wherein the sliding bodies are designed as an annular rubbing ring.

13. Pressure wave machine as claimed in claim 10, wherein the sliding bodies are designed as an annular rubbing ring.

14. Pressure wave machine as claimed in claim 11, wherein the sliding bodies are designed as annular rubbing rings.

15. Pressure wave machine as claimed in claim 8, wherein these sliding bodies are composed of a material alloy.

16. Pressure wave machine as claimed in claim 8, wherein these sliding bodies are composed of a material containing graphite.

17. Pressure wave machine as claimed in claim 8, wherein these sliding bodies are composed of a ceramic material.

18. Pressure wave machine as claimed in claim 17, wherein the ceramic material is zirconium oxide.

19. Pressure wave machine as claimed in claim 15, wherein the sliding bodies are designed as annular rubbing rings.

20. Pressure wave machine as claimed in claim 16, wherein the sliding bodies are designed as annular rubbing rings.

21. Pressure wave machine as claimed in claim 17, wherein the sliding bodies are designed as annular rubbing rings.

22. Pressure wave machine as claimed in claim 18, wherein the sliding bodies are designed as annular rubbing rings.

* * * * *